US007261584B2

(12) United States Patent
Jedynski et al.

(10) Patent No.: US 7,261,584 B2
(45) Date of Patent: Aug. 28, 2007

(54) PLUG-IN CONNECTION SYSTEM WITH AN INTEGRATED LOCK

(75) Inventors: Wieslaw Jedynski, Röthenbach (DE); Manfred Prölss, Ebermannsdorf (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/565,637

(22) PCT Filed: Jul. 22, 2004

(86) PCT No.: PCT/EP2004/008204

§ 371 (c)(1),
(2), (4) Date: Jan. 24, 2006

(87) PCT Pub. No.: WO2005/013432

PCT Pub. Date: Feb. 10, 2005

(65) Prior Publication Data

US 2006/0205260 A1 Sep. 14, 2006

(30) Foreign Application Priority Data

Jul. 25, 2003 (DE) ..... 103 34 071

(51) Int. Cl.
*H01R 13/62* (2006.01)

(52) U.S. Cl. ..... 439/368; 439/358

(58) Field of Classification Search ..... 439/368, 439/364, 352, 353, 489, 490
See application file for complete search history.

(56) References Cited

U.S. PATENT DOCUMENTS

| | | | | |
|---|---|---|---|---|
| 5,186,645 | A | 2/1993 | Bixler | |
| 5,312,268 | A | 5/1994 | Sumida | |
| 5,328,288 | A | 7/1994 | Masuda | |
| 5,486,119 | A * | 1/1996 | Nabeshima et al. | 439/489 |
| 5,632,643 | A | 5/1997 | Shepherd et al. | |
| 6,102,727 | A | 8/2000 | Kawaguchi et al. | |
| 6,126,474 | A | 10/2000 | Doye et al. | |

FOREIGN PATENT DOCUMENTS

| | | | |
|---|---|---|---|
| DE | 298 17 370 | U1 | 3/1999 |
| DE | 298173370 | U1 | 3/1999 |
| DE | 198 44 695 | A1 | 4/1999 |
| DE | 201 06 297 | U1 | 8/2001 |
| DE | 20106297 | U1 | 8/2001 |
| EP | 0 549 370 | A2 | 6/1993 |
| EP | 0549370 | A | 6/1993 |
| EP | 1 020 959 | A | 7/2000 |
| EP | 1 020 959 | A2 | 7/2000 |

* cited by examiner

*Primary Examiner*—Michael C. Zarroli
(74) *Attorney, Agent, or Firm*—Harness, Dickey & Pierce, P.L.C.

(57) ABSTRACT

A plug-in connection system is disclosed which is economical to produce, is compact, is easy to handle and/or which connects to a module in an electrically reliable manner. A plug-in connection device includes locking hooks which are provided includes locking hooks which are provided with unlocking elements. As a result, the locking hooks can be maintained in an unlocked position such that the plug-in connection can be released in a simplified manner. The unlocking elements may project in an essentially non vertical manner over the housing of the connection device or in an extrinsically vertical manner over the housing of the connection device. The total space required for the plug-in connection system is reduced, thereby ensuring that the module is connected in an electrically reliable manner.

17 Claims, 4 Drawing Sheets

PLUG-IN CONNECTION SYSTEM WITH AN INTEGRATED LOCK

This application is the national phase under 35 U.S.C. § 371 of PCT International Application No. PCT/EP2004/008204 which has an International filing date of Jul. 22, 2004, which designated the United States of America and which claims priority on German Patent Application number DE 103 34 071.8 filed Jul. 25, 2003, the entire contents of which are hereby incorporated herein by reference.

FIELD

The present invention generally relates to a plug-in connection system and/or to a plug-in connection apparatus with an integrated lock for the purpose of electrically connecting electrical modules, for example of installation devices or switching devices.

BACKGROUND

In plug-in connection systems, a large number of electrical connections generally have to be made between the modules. This is usually done by multicore connection cables whose ends are equipped with multipole connectors which are inserted into corresponding sockets on the modules.

In this case, it is necessary for it to be possible to make the plug-in connection in an equally quick and simple manner, and for a reliable electrical connection to be produced between the modules. It is also necessary to reliably lock the plug-in connections so that they withstand mechanical loads, for example vibrations and shocks, and in the process the electrical connection between the modules is maintained and remains fully functional.

Plug-in connection systems with locking apparatuses for connecting electrical modules are already known and include a connector and a socket which complements the connector, this connector and socket being connected to one another in the locked position by mechanical aids. In a known plug-in connection system of this type, the connector is connected to the socket using screws, with one or more screws being mounted on the connector such that they can rotate, and threads being provided on the socket. In the locked position, that is to say when the connector is plugged into the socket, the screws on the connector are screwed into the threads on the socket, and a firm connection is thus produced between the connector and the socket.

In order to break the connection between the connector and the socket, the screws have to be unscrewed from the threads again. This plug-in connection system therefore has the disadvantage that, in order to make and release the plug-in connection, a great deal of manipulation is needed and a large amount of space is also required both for the purpose of accommodating the screw connection and for operating the latter.

In a further plug-in connection system with a locking apparatus according to the prior art, rocker arms are arranged on the connector, engage on the socket in the locked position and thus produce a mechanical coupling between the connector and the socket. In this case, the rocker arms on the connector are resiliently mounted under prestress, so that, in the locked position, they snap into corresponding projections on, or recesses in, the socket.

In order to break the connection between the connector and the socket, it is necessary, in this plug-in connection system, to individually and manually move the rocker arms into an unlocked position in which they disengage from the projections on, or recesses in, the socket in order to allow the connector to be disconnected from the socket. This plug-in connection system therefore likewise has the disadvantage that is it relatively complicated to release the plug-in connection and a great deal of space is required to arrange the rocker arms on the connector and to operate them.

U.S. Pat. No. 5,328,288 discloses a known plug-in connection apparatus, which can be plugged onto a mating plug-in connection apparatus for electrical connection purposes in electrical modules. The plug-in connection apparatus described in that document includes a housing and a locking device which is connected to the housing and is designed to mechanically couple the plug-in connection apparatus to the mating plug-in connection apparatus. The locking device can be moved between a locked position and an unlocked position here. Furthermore, the locking device is integrally connected to the housing.

U.S. Pat. No. 5,312,268 also discloses a multi-electrode plug-in connection apparatus. This plug-in connection apparatus also includes a locking apparatus which is integrally connected to a housing, it being possible to move the locking apparatus for locking and unlocking purposes and for mechanically coupling the plug-in connection apparatus to the mating plug-in connection apparatus.

Corresponding plug-in connection apparatuses are also disclosed in EP 0 549 370 A2, EP 1 020 959 A2 and U.S. Pat. No. 6,102,727.

SUMMARY

An object of at least one embodiment of the present invention is to provide a plug-in connection apparatus and a plug-in connection system for electrical modules at a low cost, or even at the lowest cost possible. The apparatus/system of at least one embodiment may be distinguished by ease of handling and a low space requirement, and ensuring reliable electrical connection of the modules. Furthermore, a corresponding method for releasing the plug-in connection system will also be specified.

According to at least one embodiment of the invention, an object may be achieved by a plug-in connection apparatus which can be plugged into/onto a mating plug-in connection apparatus in order to electrically connect electrical modules, the apparatus having a housing and at least one locking device which is connected to the housing and serves to mechanically couple the plug-in connection apparatus to the mating plug-in connection apparatus, it being possible to move the locking device between a locked position and an unlocked position, with the locking device being integrally connected to the housing and the locking device having an unlocking element which, in the unlocked position, engages in a mating element which is arranged on the housing and complements the unlocking element, so that the locking device can be fixed in the unlocked position.

Advantages of this integral design of the locking device and housing may include simplified production of the entire system and/or simplified logistics when handling the parts for the connection system which are to be fitted. Outlay on installation may also be reduced.

At least one embodiment of the invention further provides a method for disconnecting a plug-in connection apparatus of the above type from the mating plug-in connection apparatus by fixing the at least one locking device in the unlocked position by way of the unlocking device, and releasing the plug-in connection apparatus from the mating plug-in connection apparatus.

In one example embodiment of the plug-in connection apparatus according to the invention, the locking device has at least one unlocking hook or a corresponding unlocking element. In an unlocked position, the hook/element can engage in a barb or mating element which is arranged on the housing of the plug-in connection apparatus and complements the unlocking hook. The unlocking hook may further be located at the free end of the locking hook, but it may also be arranged at another point on the locking hook at a distance from its fixed end.

In order to release the plug-in connection apparatus from the mating plug-in connection apparatus, that is to say to remove the connector from the socket for example, the locking hook may be moved from the locked position to the unlocked position, with the locking hook being disengaged from the connector by the unlocking hook engaging with the barb on the socket. In this way, the locking hook is held in the unlocked position for as long as the connector is removed or is at a distance from the socket.

Integrating a locking hook in the form of a locking device in a socket of the plug-in connection firstly reduces the space required by the locking device to a minimum, and secondly simplifies handling of the plug-in connection system overall, with a reliable electrical connection of the modules still being ensured. The plug-in connection system according to at least one embodiment of the present invention also has the advantage that locking hooks are no longer needed on the connectors of the connection cables in this case, so that the connection cables and the connectors are less susceptible to damage. For the same reason, firstly the connectors of the connection cables can be accommodated in a smaller space on the modules, and secondly less space is required for handling purposes when the connectors are fitted to the modules and when the connectors are removed from the modules. Furthermore, the plug-in connection system according to at least one embodiment of the invention is cost-effective to produce on account of the simple release operation.

The plug-in connection system according to at least one embodiment of the invention can be used to connect two or more electrical modules to one another. The modules are in each case connected by way of a multipole connection cable (for example a 10-pole connection cable) which is typically available in a variety of lengths. As a result of this, the modules can be located directly next to one another or at a distance of up to 200 cm, for example. A connector is located at the ends of each of the connection cables, whereas the mating pieces for the connectors—that is to say the sockets—are accommodated in the modules.

In one example embodiment of the plug-in connection system according to the present invention, the locking hook has a fixed end, which may be arranged on the base of the socket. As an alternative, the fixed end of the locking hook may also be arranged at another point on the socket. The locking hook may be produced from a flexible material, for example plastic, and may be arranged on the socket by way of its fixed end in such a way that it has resilient properties on account of its flexibility.

The locking hook also may have a free end which produces the mechanical coupling between the connector and the socket. This coupling is produced by the free end of the locking hook engaging on the connector as soon as the connector is in the locked position, that is to say is fully inserted into the socket. In this case, it is particularly advantageous when the free end of the locking hook has a projection which, in the locked position, engages in a recess in the connector, which recess complements the projection. The projection in the locking hook consequently interacts with the recess in the connector in such a way that the connector is reliably held in the locked position.

It is particularly advantageous when the unlocking hook of the locking hook and the barb on the socket engage in such a way that the unlocking hook automatically disengages from the barb when the connector is inserted into the socket. In this way, the connector and the socket are locked solely by inserting the connector into the socket as soon as the connector has reached the locked position, without further manipulation or additional operation of the locking hook or hooks being required.

In addition, the locking hook can be resiliently mounted on the socket in such a way that it is prestressed toward its locked position on account of its flexibility, so that the locking hook automatically snaps into the locked position when the connector is inserted into the socket.

The insertion movement of the connector into the socket can be further simplified when the free end of the locking hook has an edge which is inclined essentially in the direction of the insertion movement of the connector into the socket. In this case, it is particularly advantageous when the edge directly adjoins the projection which engages on the connector in the locked position. During the insertion movement of the connector into the socket, the connector can slide on the edge at the free end of the locking hook and in the process push the locking hook toward the unlocked position. As soon as the connector is inserted into the socket to such an extent that it has reached the locked position, the locking hook can snap back and fix the connector in the locked position.

The plug-in connection apparatus according to at least one embodiment of the invention can be particularly reliably designed when a respective locking device is provided on two opposite sides of the housing, the locking devices engaging on the connector or the mating plug-in connection apparatus in the locked position. This produces a stable mechanical coupling between the connector and the socket on two opposite sides.

BRIEF DESCRIPTION OF THE DRAWINGS

Example embodiments of the present invention will now be explained in greater detail with reference to detailed description and the attached drawings, in which.

DETAILED DESCRIPTION OF THE EXAMPLE EMBODIMENTS

The example embodiment described in greater detail below represents a preferred embodiment of the present invention.

In order to be better able to understand the way in which the plug-in connection system according to at least one example embodiment of the invention operates, plug-in connection systems according to the prior art are first explained in greater detail with reference to FIGS. 1 to 3.

Figure 1:
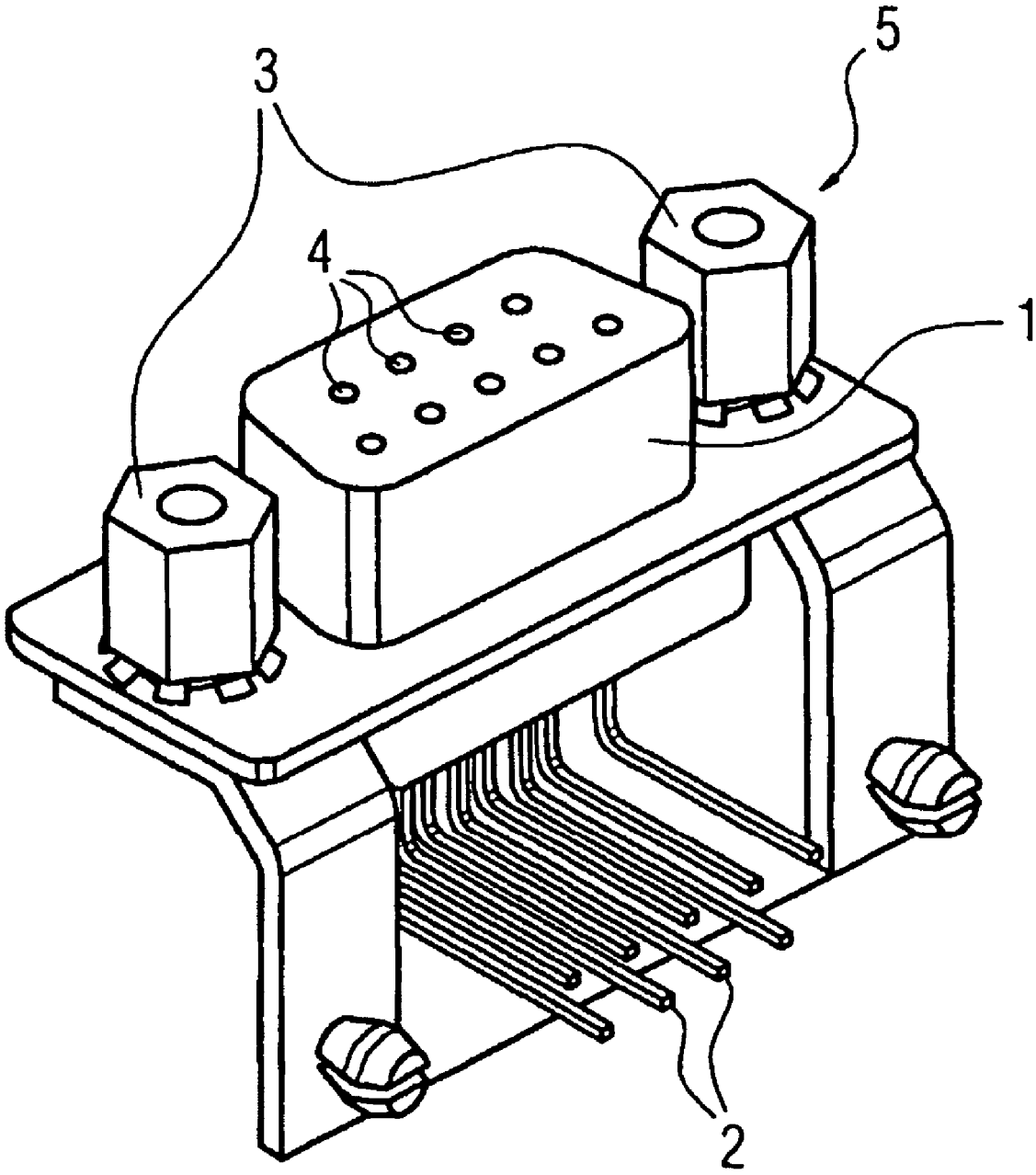
FIG 1 (Prior art)
FIG. 1 shows a so-called D-sub socket for electrically connecting electrical modules according to the prior art.

FIG. 1 illustrates a so-called D-sub socket 5 for electrically connecting electrical modules according to the prior art. This socket 5 comprises a mating piece 1 onto which a complementary connector (not illustrated) of a connection line can be plugged. The mating piece 1 has a plurality of pole connections 4 which open into corresponding lines 2 on the lower side of the socket, these lines leading to an electrical module (not illustrated). In this known plug-in connection system, the connector is fixed using screw connections. Threads 3 are provided on the socket 5, it being possible for screws (not illustrated) which are rotatably mounted on the connector to be screwed into said threads. When the connector is inserted into the socket 5, the screws on the connector are screwed into the threads 3 on the socket, and a firm connection is thus produced between the connector and the socket 5.

In order to break the connection between the connector and the socket 5, the screws have to be unscrewed from the threads 3 again. This plug-in connection system therefore has the disadvantage that, in order to make and release the plug-in connection, a great deal of manipulation is needed and a large amount of space is also required both for the purpose of accommodating the screw connection and for operating the latter.

Figure 2:
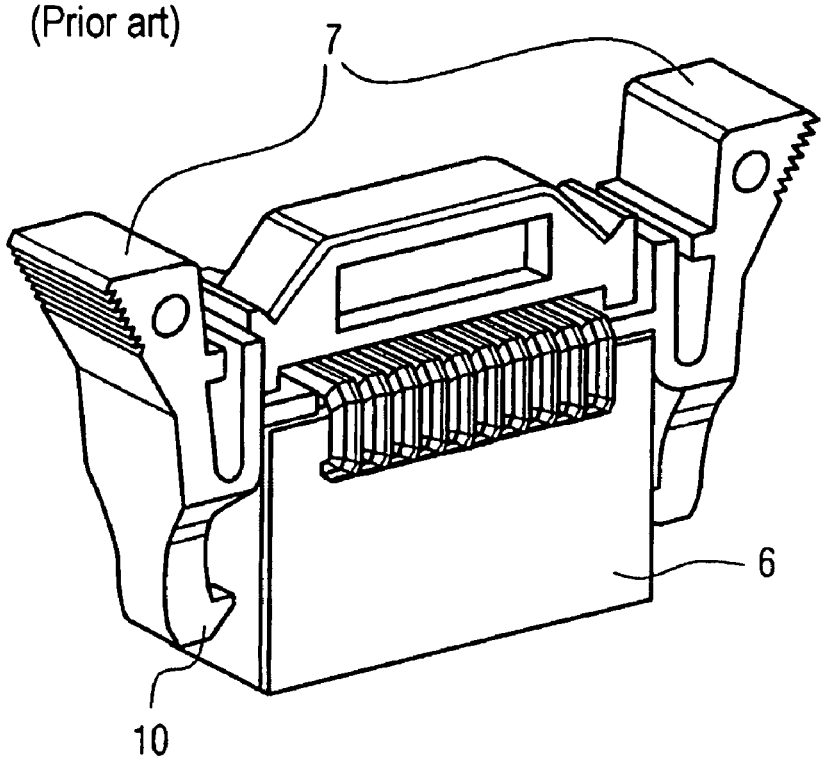
FIG 2 (Prior art)
FIG. 2 shows a so-called 2.54 mm-pitch connector of a connection line for electrically connecting electrical modules according to the prior art.

FIG. 2 illustrates a 2.54 mm-pitch connector 6 of a connection line for electrically connecting electrical modules according to the prior art. In this plug-in connection system, the connector 6 latches into the socket (not illustrated). To this end, rocker arms 7 are arranged on the connector 6 and, in the locked position, engage with a hook 10 on the socket 8, and thus produce a mechanical coupling between the connector 6 and the socket 8. In this case, the rocker arms 7 are resiliently mounted on the connector 6 in such a way that they can be pivoted between a locked position and an unlocked position. The rocker arms 7 are prestressed toward the locked position. It can be clearly seen that the rocker arms 7 represent the highest vertical point of the connector and therefore increase the amount of space required by electrical modules which are connected to connectors of this type.

Figure 3:
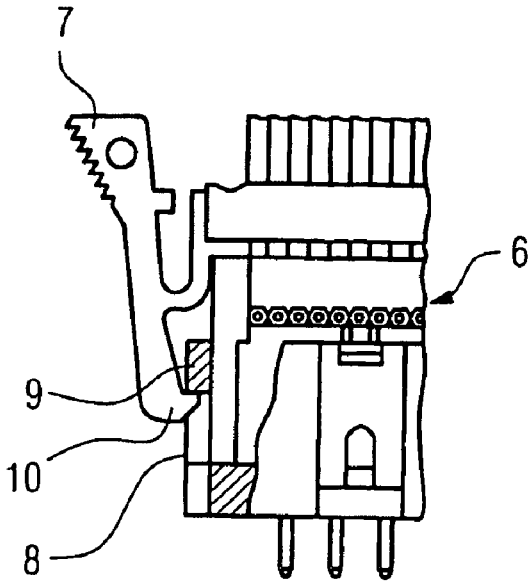
FIG 3 (Prior art)
FIG. 3 shows a view of a detail of the 2.54 mm-pitch connector from FIG. 2 for electrically connecting electrical modules according to the prior art.

FIG. 3 illustrates a view of a detail of the 2.54 mm-pitch connector 6 which is shown in FIG. 2 and serves to electrically connect electrical modules according to the prior art. FIG. 3 shows that, in the locked position, the hook 10 of the rocker arm 7 on the connector 6 snaps into a corresponding engagement section 9 on the socket 8 as soon as the connector 6 is inserted into the socket 8 as far as the locked position.

In order to break the connection between the connector 6 and the socket 8, it is necessary, in this plug-in connection system, to individually and manually move the rocker arms 7 into the unlocked position in which the hooks 10 disengage from the engagement sections 9 on the socket 8 in order to allow the connector 6 to be disconnected from the socket 8. This plug-in connection system therefore likewise has the disadvantage that releasing the plug-in connection is associated with a great deal of manipulation and a large amount of space is required to arrange the rocker arms 7 on the connector 6 and to operate the latter. The rocker arm 7 is also in the form of a separate part which has to be attached to the plug-in connection system. Therefore, an additional part is disadvantageously required, it being expedient to dispense with this part.

Figure 4:
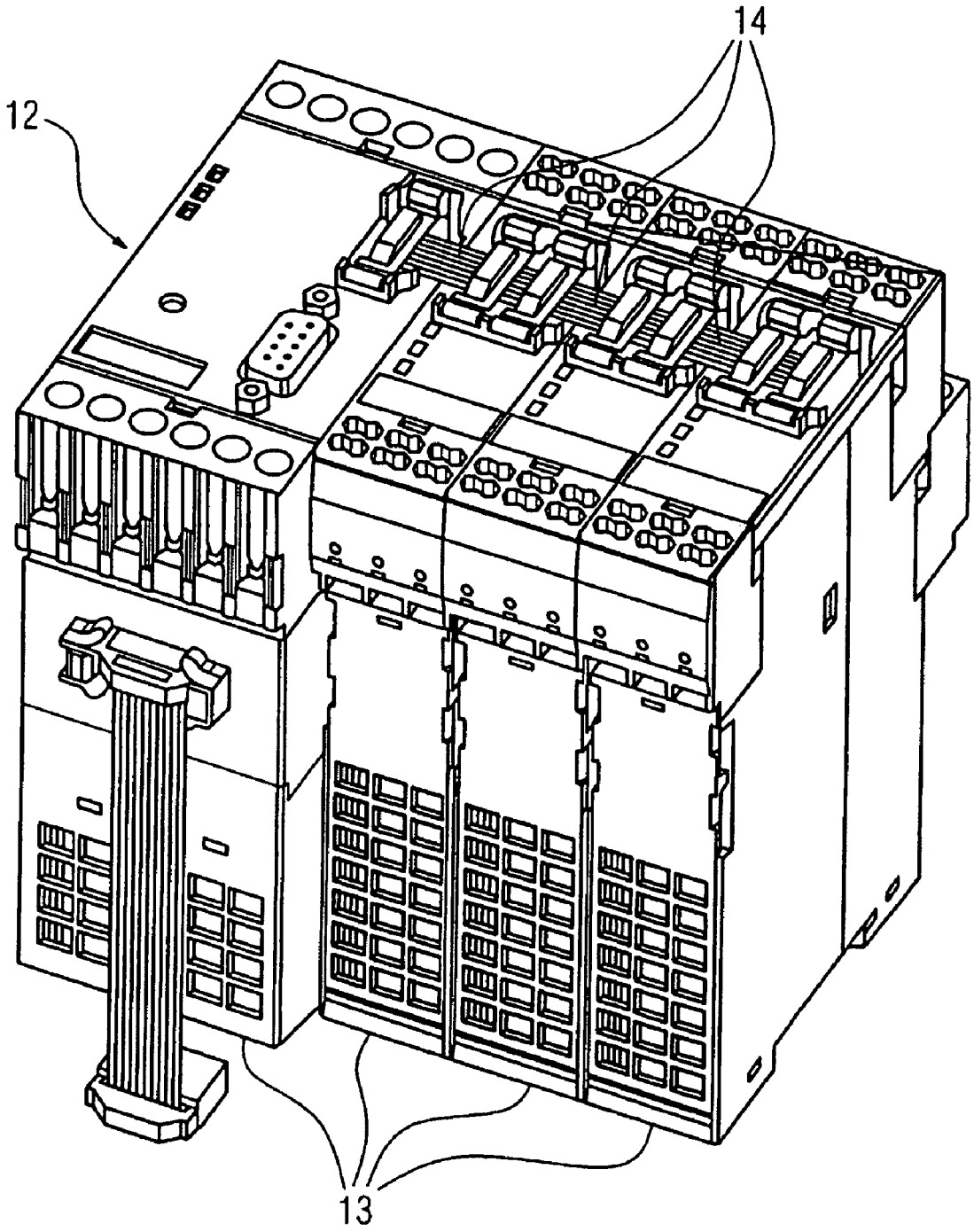
FIG. 4 shows a module assembly comprising a plurality of electrical modules.

FIG. 4 illustrates a module assembly 12 which comprises a plurality of electrical modules 13. The modules 13 are electrically connected to one another via connection lines 14. The connection lines 14 comprise ribbon lines and their ends are each provided with connectors which are plugged into corresponding sockets in the modules 13. The connection between the connection cable and the module is improved using the plug-in connection system with unlocking elements according to at least one example embodiment of the present invention.

Figure 5:
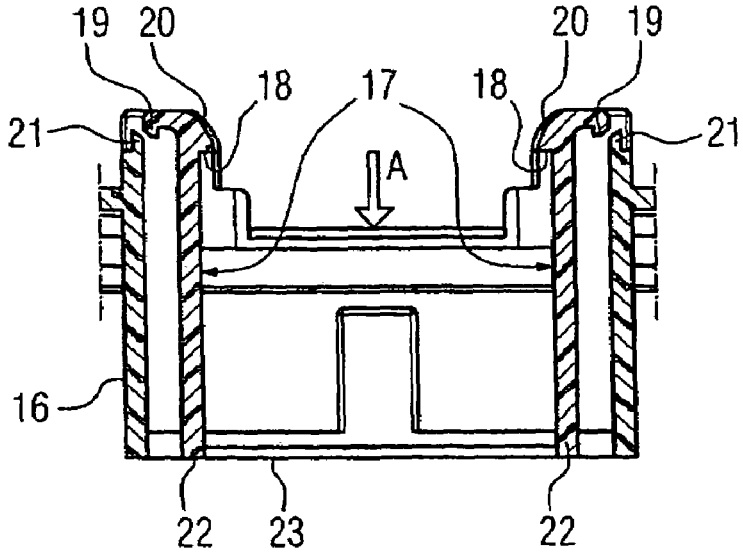
FIG. 5 shows a schematic illustration of one example embodiment of the plug-in connection apparatus with an integrated lock according to the present invention.
Figure 6:
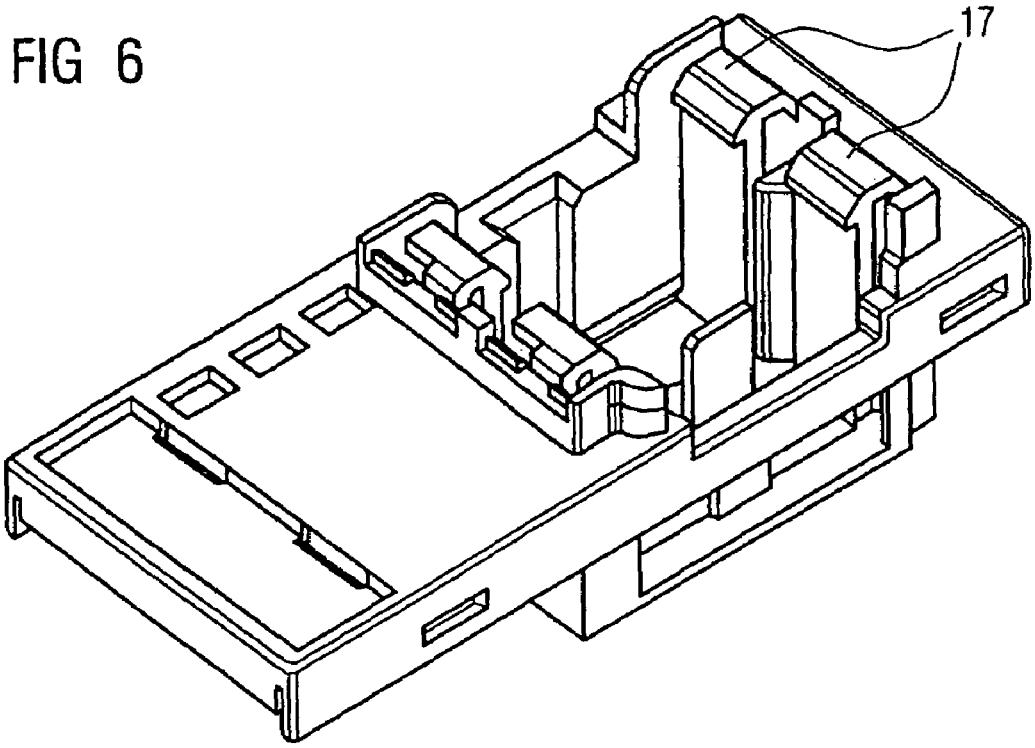
FIG. 6 shows a perspective illustration of a cover with the plug-in connection apparatus according to FIG. 5.

FIG. 5 shows a schematic illustration of an example embodiment of the plug-in connection apparatus with unlocking elements according to the present invention. FIG. 6 shows a perspective illustration of a cover of the example embodiment of the plug-in connection apparatus, which is shown in FIG. 5, according to at least one example embodiment of the present invention. The embodiment described below is based on a known plug-in connection with a 2.54 mm pitch, however other standard systems may also be chosen for the purpose of implementing at least one example embodiment of the present invention.

FIG. 5 shows the plug-in connection apparatus according to at least one example embodiment of the invention in the locked position. A standard connector (not illustrated) can be fully inserted into a housing 16 of the plug-in connection apparatus which complements the connector. In the illustrated embodiment, the plug-in connection apparatus according to the invention comprises two locking hooks 17 for mechanically coupling the connector to the housing 16, with the locking hooks 17 being integrated in the housing 16. The locking hooks 17 are arranged on two opposite sides of the housing 16.

Both the housing 16 and the locking hooks 17 are produced from a flexible material, for example plastic. The locking hooks 17 have a fixed end 22 which is respectively arranged on the base 23 of the housing 16 of the socket, with the locking hooks 17 being resiliently mounted on account of their flexibility. In this case, the locking hooks 17 are prestressed toward their locked position.

Furthermore, the locking hooks 17 each have a free end on which an inwardly protruding projection 18 is formed. The projection 18 at the free end of the locking hooks 17 produces a mechanical coupling between the connector and the socket 16 by the projection 18 engaging into a corresponding recess or engagement section on the connector as soon as the connector is fully inserted into the socket or its housing 16 in the direction of the arrow A, and is therefore in the locked position. The connector is reliably held in its locked position in this way.

The free ends of each of the locking hooks 17 are additionally provided with an edge 20, which edges have a rounded portion 20 which is inclined in the direction of the insertion movement A of the connector into the socket or into the housing 16, with the edge 20 directly adjoining the projection 18 which engages on the connector in the locked position. As a result, the connector can slide on the edge 20 at the free end of the locking hooks 17 during the insertion movement into the socket 16 in the direction of the arrow A, and in the process push the locking hooks 17 outward. As soon as the connector is fully inserted into the socket 16 and has reached the locked position, the locking hook 17 snaps back on account of its prestress and fixes the connector in the locked position.

Furthermore, the free ends of the locking hooks 17 each have an unlocking hook 19 which, in an unlocked position, engages in a barb 21 which is arranged on the housing 16 and complements the unlocking hook. In order to remove the connector from the housing 16, the locking hooks 17 are moved out of the locked position into the unlocked position by the locking hooks 17 being pushed outward. In this case, the projections 18 of the locking hooks 17 are firstly disengaged from the engagement sections on the connector, and secondly the unlocking hooks 19 are pushed across the barbs 21 on the housing 16 until said unlocking hooks and barbs engage with one another. In this way, the mechanical coupling between the connector and the socket or the housing 16 is released, and the connector can be removed from the socket 16. The locking hooks 17 are held in the unlocked position by the engagement between the unlocking hooks 19 and the barbs 21 on the socket 16.

In order to release the engagement between the unlocking hooks 19 on the free ends of the locking hooks 17 and the barbs 21 on the housing 16, the unlocking hooks 19 are again pushed back across the barbs 21. However, it is particularly advantageous when the engagement between the unlocking hook 19 of the locking hook 17 and the barb 21 on the socket 16 is automatically released when the connector is inserted into the socket 16 by the barbs 21, which should be designed to move in a corresponding manner (not illustrated in the figures), being moved downward when the connector is pressed in, for example.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A plug-in connection apparatus for plugging into or onto a mating plug-in connection apparatus to electrically connect electrical modules, comprising:

a housing; and at least one locking device being movable between a locked position and an unlocked position, being integrally connected to the housing, including a locking element that mechanically couples the plug-in connection apparatus to the mating plug-in connection apparatus when the locking device is in the locked position, and including an unlocking element that engages with a mating element on the housing when the locking device is in the unlocked position to retain the locking device in the unlocked position.

2. The plug-in connection apparatus as claimed in claim 1, wherein the locking device includes at least one of a locking hook and a locking eye for mechanical coupling to the mating plug-in connection apparatus.

3. The plug-in connection apparatus as claimed in claim 1, wherein the locking device includes an end which is rigidly connected to the housing, as a result of which the locking device is resiliently mounted on the housing.

4. The plug-in connection apparatus as claimed in claim 1, wherein the unlocking element includes at least one of an unlocking hook and an unlocking eye.

5. The plug-in connection apparatus as claimed in claim 1, wherein the unlocking element and the mating element engage in such a way that the unlocking element automatically disengages from the mating element when the plug-in connection apparatus is inserted into the mating plug-in connection apparatus.

6. The plug-in connection apparatus as claimed in claim 1, wherein the locking device is resiliently mounted on the housing in such a way that it is prestressed toward the locked position, so that the locking device automatically snaps into the locked position when the plug-in connection apparatus is inserted into the mating plug-in connection apparatus.

7. The plug-in connection apparatus as claimed in claim 2, wherein the free end of the locking hook includes an edge inclined essentially in the direction of the insertion movement of the plug-in connection apparatus into the mating plug-in connection apparatus.

8. The plug-in connection apparatus as claimed in claim 7, wherein the edge directly adjoins a projection of the locking hook, which projection engages on the connector in the locked position.

9. The plug-in connection apparatus as claimed in claim 1, wherein a respective locking device is provided on two opposite sides of the housing.

10. A plug-in connection system, comprising:

the plug-in connection apparatus as claimed in claim 1, in the form of a socket; and the mating plug-in connection apparatus which corresponds to a connector.

11. A method for disconnecting the plug-in connection apparatus as claimed in claim 1 from the mating plug-in connection apparatus, the method comprising:

fixing the at least one locking device in the unlocked position via the unlocking element; and releasing the plug-in connection apparatus from the mating plug-in connection apparatus.

12. The plug-in connection apparatus as claimed in claim 2, wherein the locking device includes an end which is rigidly connected to the housing, as a result of which the locking device is resiliently mounted on the housing.

13. The plug-in connection apparatus as claimed in claim 2, wherein the unlocking element includes at least one of an unlocking hook and an unlocking eye.

14. The plug-in connection apparatus as claimed in claim 2, wherein the unlocking element and the mating element engage in such a way that the unlocking element automatically disengages from the mating element when the plug-in connection apparatus is inserted into the mating plug-in connection apparatus.

15. A plug-in connection system, comprising:

the plug-in connection apparatus as claimed in claim 2, the apparatus being in the form of a socket; and the mating plug-in connection apparatus which corresponds to a connector.

16. A plug-in connection system, comprising:

the plug-in connection apparatus as claimed in claim 2, in the form of a connector; and the mating plug-in connection apparatus which corresponds to a socket.

17. A method for disconnecting the plug-in connection apparatus as claimed in claim 2 from the mating plug-in connection apparatus, the method comprising:

fixing the at least one locking device in the unlocked position via the unlocking element; and releasing the plug-in connection apparatus from the mating plug-in connection apparatus.

* * * * *